United States Patent [19]

Walley

[11] Patent Number: 5,024,159

[45] Date of Patent: Jun. 18, 1991

[54] PLANE-WAVE FORMING SHEET EXPLOSIVE

[76] Inventor: David H. Walley, P.O. Box 396, Muskogee, Okla. 74402

[21] Appl. No.: 49,547

[22] Filed: May 14, 1987

[51] Int. Cl.[5] ..... C06D 00/00

[52] U.S. Cl. ..... 102/289; 102/290; 102/321; 102/323; 102/332

[58] Field of Search ..... 102/305, 307, 321, 323, 102/331, 332, 288, 290

[56] References Cited

U.S. PATENT DOCUMENTS

| | | | |
|---|---|---|---|
| 3,122,096 | 2/1964 | Wick | 102/323 |
| 3,218,972 | 11/1965 | Loving et al. | 102/332 |
| 3,323,455 | 6/1967 | Griffith | 102/323 |
| 4,435,481 | 3/1984 | Baldi | 102/336 X |
| 4,471,697 | 9/1984 | McCormick et al. | 102/202.14 |
| 4,602,565 | 7/1986 | MacDonald et al. | 102/202.14 X |
| 4,649,825 | 3/1987 | Quick et al. | 102/321 X |

*Primary Examiner*—Peter A. Nelson

[57] ABSTRACT

An explosive sheet which is formed by a layer of explosive material, a layer of foil, and an inert space forming material. These three layers are repeated to number, n, times to form a composite plane-wave forming explosive sheet.

16 Claims, 1 Drawing Sheet

PLANE-WAVE FORMING SHEET EXPLOSIVE

GENERAL DESCRIPTION OF THE INVENTION

This invention relates generally to high explosive technology useful for initiating base explosive charges. More particularly, a sheet explosive comprising alternating layers of high explosive, metal foil, and inert space forming material when upon detonation of the top sheet at any point produces a plane detonation wave exiting the base of the multi-layered sheet. The invention is useful for initiating the entire surface area of a geometrically shaped base charge, thus forming focused detonation waves about a geometric center.

Numerous complex techniques are employed to initiate a desired geometric wave in a base explosive. It has been found that focused detonation waves converging on metal target materials promote optimum transfer of the available explosive energy to target material kinetic energy, thus it is desired to focus the detonation wave by the use of explosive lenses. Explosive lenses are somewhat complex in configuration and are sometimes not very reliable because of the uncertainty in explosive velocities and machining errors.

Further, explosive lenses are somewhat costly and require use of multiple initiation sites to generate a converging geometric wave such as, for example, a cylindrical implosion.

In view of this design inefficiency, the present invention provides a novel as well as an economic material to initiate a focused detonation wave in any geometry. Because of this, complex initiation schemes such as those to produce explosive driven implosions in spherical, cylindrical, ellipsoidal coordinates are eliminated. Particularly those geometries employed for producing directional blast penetrating weapons can be efficiently designed using minimum amounts of explosive and space.

DETAILED DESCRIPTION

Figures 1, 2:
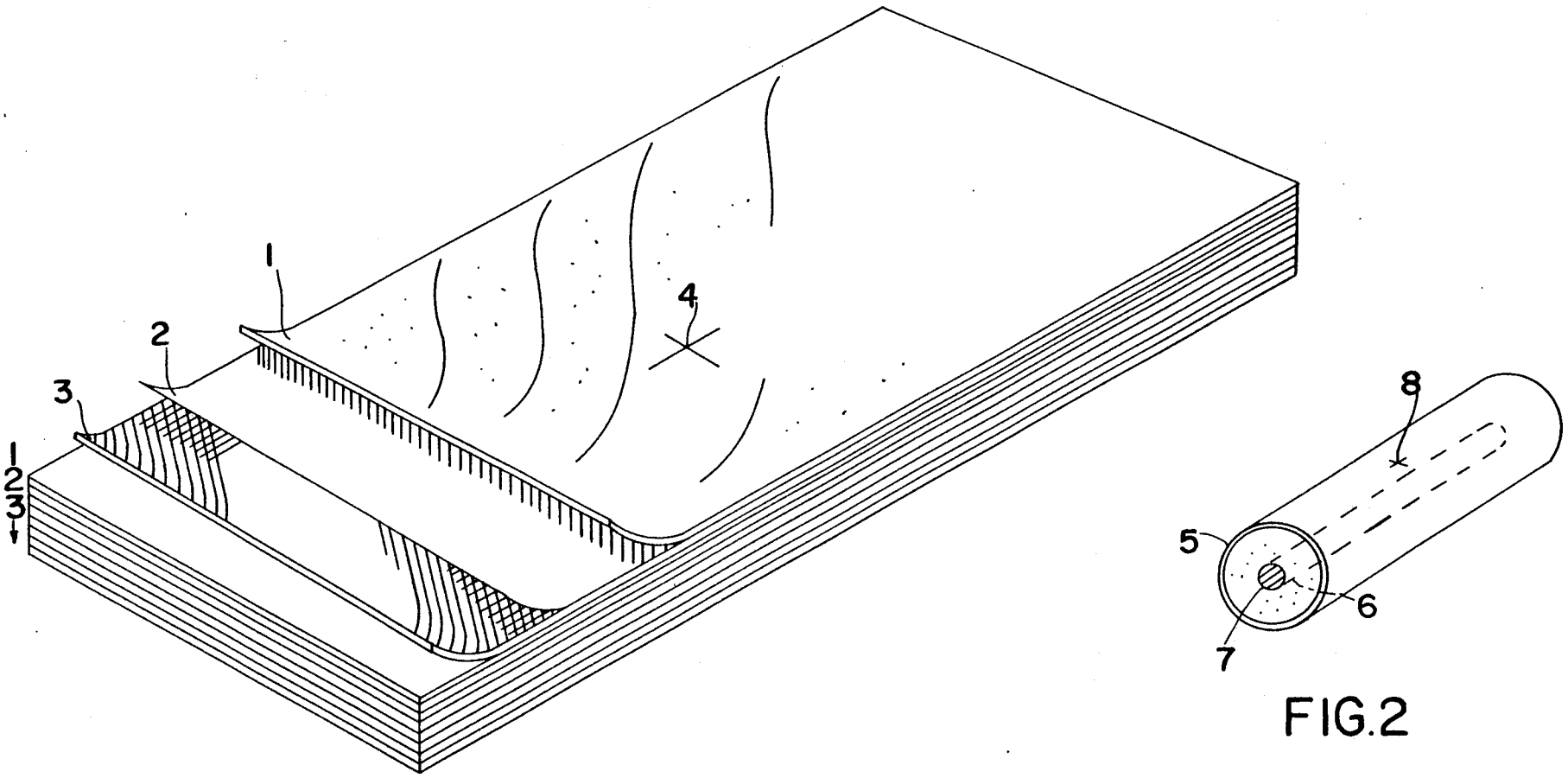
FIG. 1 illustrates a multilayer explosive shown as a flat configuration.
FIG. 2 is a cylindrical implosively loaded projectile.

The detonation wave shaping flexible sheet explosive of the present invention can be best described by the following illustration. As illustrated in FIG. 1, the flexible sheet explosive comprises alternating layers of explosive(1), flyer foil(2), and space forming material (foam)(3). These are laminated in the recurring sequence 1,2,3; 1,2,3 . . . Proper initiation of the sheet at (4) is by a miniaturized detonation device comprising a detonating primary or secondary explosive. The device must be sufficiently small in explosive mass such that an increase in relative mass parameter (explosive mass/ flyer foil mass) is negligible. Large initiators such as booster buttons and blasting caps have a tendency to blast through and initiate all explosive layers simultaneously, thus destroying the wave-shaping effect of the present invention.

Use of the present invention can be illustrated in FIG. 2. A cylindrical charge of high explosive (6) surrounding a metal rod projectile (7) is jacketed with the flexible wave-shaping explosive of the present invention (5). The wave shaping explosive is formed by laminations of explosive, foil and foam as shown in FIG. 1. Initiation and detonation of this charge at point (8) by a miniaturized detonation device as shown at (4) produces a homogeneous cylindrical implosion in the base charge (6) which converges on and drives the rod projectile (7) into a hyper-velocity bullet. This high aspect ratio bullet is useful for penetrating thick dense hard targets such as armor. This device is referred to as "in-situ" kinetic energy penetrator and is useful as a warhead for missiles driven by low velocity highly efficient turbine engines.

It has been determined that the foil layer may be a metal, a plastic or an inorganic material. Further, it has been determined that the foil layer may be replaced with an explosive whose detonation velocity is much less than that of the explosive layer. Also, it has been determined that the explosive wave form may be formed without the foam layer.

The space forming material as set forth may be a metal, a plastic, or an inorganic foam.

The method and material of the present invention relies on the expansion of the theory of the laws of geometrical optics. The mathematical proof is provided for those that doubt the method and material of the present invention:

$$\lim_{n \to \infty} \sin^{-1}((V_1/V_2)^n) = \text{alpha} - 0$$

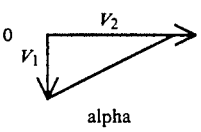

$V_2$=explosive detonation velocity;

$V_1$=free surface velocity of flying foil or shock.

Alpha equals the detonation wave angle, n equals the number of layers of composite. One can't have n=infinity, however, if $V_1/V_2$ is small which is the case, n can be within the range 0–10 in which alpha is approximately=O.

The explosive sheet is flexible and can be cut and wrapped around curved surfaces, such as, for example, cylinders and spheres. Initiation from a single point of the top sheet will produce a geometrically shaped wave exiting the base of the sheet. The sheet is composed of 3 separate and distinctive alternating layers laminated into one continuous layer. The three discrete layers comprise:

1. An explosive of a given thickness, shock initiation sensitivity, and critical detonation diameter.
2. A metal or plastic foil of a given thickness, density.
3. A space forming material such as a metal or plastic foam of a given thickness, density, shock parameter.

The thickness of the explosive layer is within the range 0–0.25 inches, shock initiation sensitivety within the range 0–0.125 inches under the appropriate shock pressure. The critical detonation diameter is within the range 0–0.1 inch within the proper confinement.

The thickness of the metal or plastic layer is within the range 0–0.1 in. The density is within the range 0–20 g/cc and more preferably 0–15 g/cc.

The thickness of the space forming material is within the range 0–0.25 inches, the density is within the range 0–2.5 g/cc, the shock parameter is within the range 0–5 km/s. The alternating layers are mostly preferred to be explosive/foil/void-explosive/foil/void . . .

The proper combination of thicknesses of the various layers along with other specific properties applied is the key to generating the novel material of the present invention. For example, a layer of explosive less than the critical diameter or thickness will not propagate into detonation when hit by the flying foil. Further, the thickness of the explosive can be 2–3 times the critical diameter for detonation. However, the distance to detonation by flyer impact might be greater than the thickness of the explosive and thus detonation will not occur in the next layer. Thus, there is an optimum combination of explosive type, foil type, voidous space forming material such that a uniform detonation propagates from layer to layer. The generation of the material of the present invention in a number of different optimum combinations are within the scope of the present invention.

Further, the use of multiple discrete laminates eliminates error associated with variations in velocity, material thickness, etc. This is the result of the error to the nth power which becomes negligible when n is within the range 0–10. Hence, prior art initiation schemes can comprise one layer, the error being 1–2% in the overall initiation of the base charge. Also, a 1–2% error on initiation of the base charge can result in an error of 5–10% because of the effects of the convergence reaction.

Presently, there are enough analytical models available to describe the behavior of metal acceleration under detonation loading. These models are closed form solutions which can be solved by the use of a small calculator. Errors by using the models can be as low as 1–2%. However, misuse of the models can develop error of a much greater magnitude The following example represents one optimum combination of the invention set forth in the present invention:

EXAMPLE 1

Three layers in the laminate comprising:

1. XTX-8003 explosive(PETN/SILICONE RUBBER) of about twenty mils thickness bonded to a copper foil.
2. The copper foil has a density of about 8.9 g/cc with a thickness of about 5.5 mils which is bonded to a polyethylene closed cell foam.
3. The polyethylene closed cell foam has a density of about 0.05 g/cc with a thickness of about 20 mils This laminate is then laminated on itself a number of times (n) In the order 1,2,3,1,2,3,1,2,3, . . .

Upon detonation of the top sheet, the copper foil will accelerate to a velocity of about 1 Km/s; the explosive will detonate across the sheet at about 7.3 Km/s($V_2$). Thus, from the equation previously presented for n equal 5 layers;

$$\mathrm{Sin}^{-1}((1/7.3)^5)=\text{alpha}=2.76\ \text{EE-3 degrees}$$

For n=10;

$$\mathrm{Sin}^{-1}((1/7.3)^{10})=1\text{EE}-7\ \text{degree}$$

It is believed that there is no other technique to give such a precise detonation wave.

Having thus described the invention with a certain degree of particularity, it is to be understood that the invention is not limited to the embodiments set forth herein for purposes of exemplification, but is to be limited only by the scope of the attached claims, including a full range of equivalents to which each element thereof is entitled.

I claim:

1. A point initiated geometric waveforming flexible explosive sheet comprising:

a recurring sequence of alternating layers of explosive, foil, and a spacer forming material in order.

2. A flexible explosive sheet as set forth in claim 1 in which said sheet initiates a base charge whose detonation wave focuses about a geometric center.

3. A flexible explosive sheet as set forth in claim 1 in which said foil layer is selected from a metal, plastic, or inorganic material.

4. A flexible explosive sheet as set forth in claim 1 in which said space forming material has a thickness of from 0 to about 0.25 inches with a density of from 0 to about 2.5 9/cc.

5. A flexible explosive sheet as set forth in claim 1 in which said foil layer is replaced with an explosive whose detonation velocity is much less than the explosive layer

6. A flexible explosive sheet as set forth in claim 1 in which said space forming material is selected from a metal, a plastic, or an inorganic foam.

7. A flexible explosive sheet as set forth in claim 1, in which said explosive layer has a detonation velocity between 3–13 Km/s.

8. A flexible explosive sheet as set forth in claim 1, in which said flexible explosive sheet surrounds a base charge to drive a collapsing liner or projectile into a penetrating device.

9. A flexible explosive sheet as set forth in claim 1, in which said flexible explosive sheet initiates a base charge whose detonation wave diverges away from a geometric center.

10. A flexible explosive sheet as set forth in claim 1 in which said layer of explosive material has a thickness of from about 0 to about 0.25 inches with a shock initiation sensitivity within a range of from 0 to about 0.25 inches.

11. A flexible explosive sheet as set forth in claim 1 in which said foil layer has a thickness of from 0–0.10 inches with a density of from 0 to about 20 g/cc.

12. A flexible explosive sheet as set forth in claim 4 in which said space forming material has a shock parameter within a range of from 0 to about 5 km/s.

13. A flexible explosive sheet as set forth in claim 10 in which said foil layer has a thickness of from 0–0.10 inches with a density of from 0 to about 20 g/cc.

14. A flexible explosive sheet as set forth in claim 10 in which said space forming material has a thickness of from 0 to about 0.25 inches with a density of from 0 to about 2.5 9/cc.

15. A flexible explosive sheet as set forth in claim 11 in which said space forming material has a shock parameter within a range of from 0 to about 5 km/s.

16. A flexible explosive sheet as set forth in claim 15 in which said space forming material has a shock parameter within a range of from 0 to about 5 km/s.

* * * * *